US006145166A

United States Patent [19]

Waeber et al.

[11] Patent Number: 6,145,166

[45] Date of Patent: Nov. 14, 2000

[54] TRASH ELIMINATION APPARATUSES FOR FIBER CLEANING AGGREGATES

[75] Inventors: Renè Waeber; Walter Schlepfer, both of Winterthur; Beat Näf, Jona; Christian Sauter, Flurlingen; Jürg Faas, Andelfingen, all of Switzerland

[73] Assignee: Maschinenfabrik Rieter AG, Winterthur, Switzerland

[21] Appl. No.: 09/127,069

[22] Filed: Jul. 30, 1998

[30] Foreign Application Priority Data

| | | | |
|---|---|---|---|
| Jul. 30, 1997 | [CH] | Switzerland | 1819/97 |
| Aug. 22, 1997 | [CH] | Switzerland | 19/97 |
| Jun. 13, 1998 | [DE] | Germany | 298 10 665 |
| Jun. 19, 1998 | [DE] | Germany | 298 10 964 |

[51] Int. Cl.[7] ..... D01G 15/76

[52] U.S. Cl. ..... 19/109; 19/104; 19/113; 19/200

[58] Field of Search ..... 19/98, 104, 105, 19/108, 109, 110, 112, 113, 200, 202, 203, 204, 205

[56] References Cited

U.S. PATENT DOCUMENTS

| | | | |
|---|---|---|---|
| 4,135,276 | 1/1979 | Hanschuch et al. . | |
| 4,797,980 | 1/1989 | Jagst . | |
| 4,805,268 | 2/1989 | Leifeld . | |
| 4,969,235 | 11/1990 | Marx | 19/105 |
| 4,972,552 | 11/1990 | Graf | 19/113 |
| 4,985,966 | 1/1991 | Nitschke et al. . | |
| 5,031,279 | 7/1991 | Temburg | 19/104 |
| 5,181,295 | 1/1993 | Demuth et al. . | |
| 5,228,170 | 7/1993 | Giuliani | 19/104 |
| 5,241,726 | 9/1993 | Pezzoli et al. | 19/200 |
| 5,247,721 | 9/1993 | Demuth et al. | 19/105 |
| 5,255,415 | 10/1993 | Leifeld et al. . | |
| 5,313,688 | 5/1994 | Leifeld et al. | 19/203 |
| 5,448,800 | 9/1995 | Faas et al. | 19/108 |
| 5,530,994 | 7/1996 | Loeffler | 19/109 |

FOREIGN PATENT DOCUMENTS

| | | | |
|---|---|---|---|
| 0583219B1 | 2/1994 | European Pat. Off. . | |
| 0810309A1 | 12/1997 | European Pat. Off. . | |
| 0848091A1 | 6/1998 | European Pat. Off. . | |
| 9419619 | 3/1995 | Germany . | |
| 0423856A1 | 4/1991 | Italy | 19/109 |
| 2245604 | 1/1992 | United Kingdom . | |

*Primary Examiner*—Michael A. Neas
*Assistant Examiner*—Gary L. Welch
*Attorney, Agent, or Firm*—Dority & Manning

[57] ABSTRACT

In a fiber processing machine with a separating edge in which fibers as well as air are guided in a substantially predetermined transporting direction past the edge, trash particles are selectively removed from the fiber/air stream with the help of the edge. The adjustment of a separating element, in particular, the setting of the angular position of a separating surface and/or the penetration depth upstream from the separating surface is linked with an adaptation of the width of the eliminating gap. Also, at least one measure can be taken for eliminating, as far as possible, a pressure drop and/or air turbulences downstream (in the transporting direction) from the edge. Downstream from the edge, a flow pattern as laminar as possible is generated or maintained, respectively.

17 Claims, 10 Drawing Sheets

600
104
105
602
608
616
612
106
600
608
606
602
FLS
620
610
618
107
612
616
622
610
620
EB
606
618
108
600
608
622
616
EB
612
620
602
610
EB
618
109
606

Fig.9A
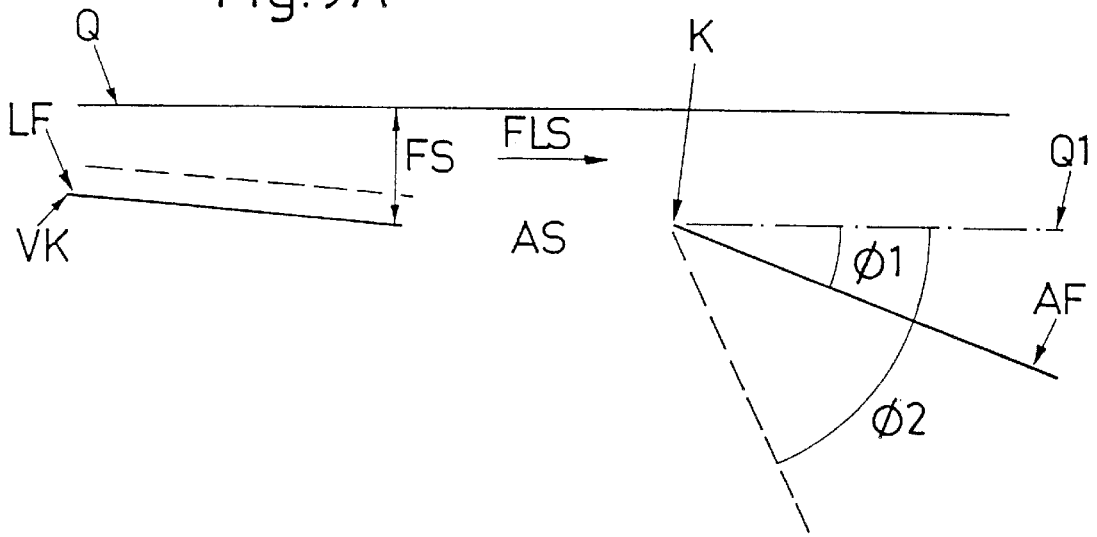
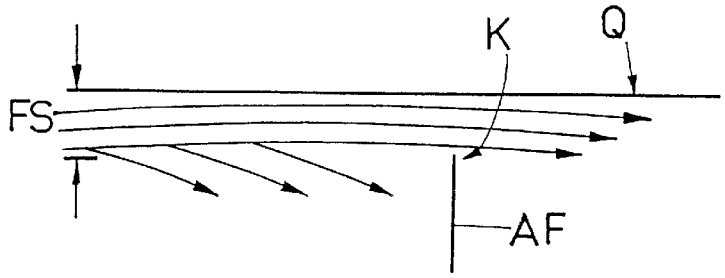
Fig.9B
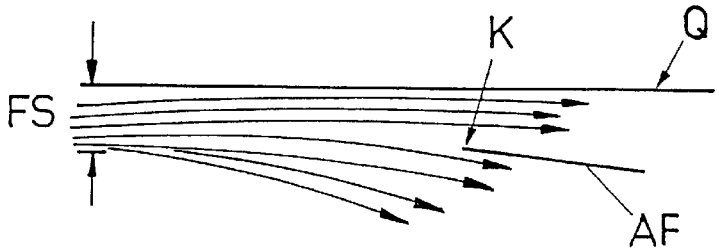
Fig.9C
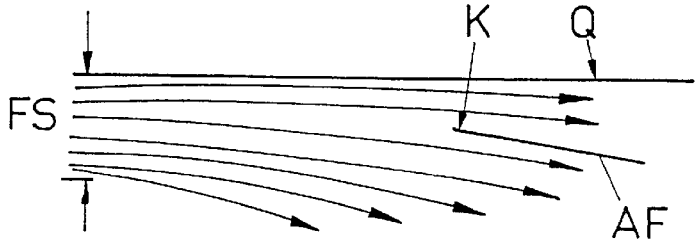
Fig.9D
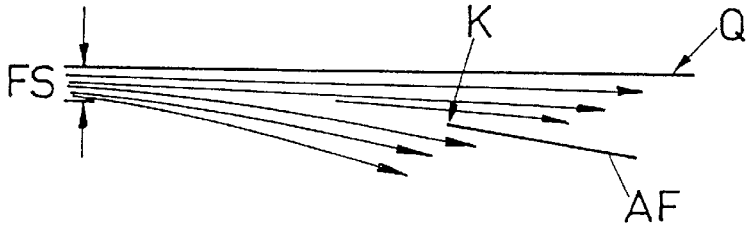
Fig.9E 104
500
105
β
502
106
P
500
33
GE
107
GE
502
β
514
516
GE
513
502
512
109
504
508
500
506
108
510

TRASH ELIMINATION APPARATUSES FOR FIBER CLEANING AGGREGATES

BACKGROUND OF THE INVENTION

The present invention concerns trash removal apparatuses (devices for eliminating impurities) for application in fiber cleaning aggregates of a spinning mill and corresponding aggregates.

In principle, it is known that trash removal apparatuses equipped with "knives" or "blades" are provided on cards as well as on (fiber flock) cleaning machines. In a conventional fiber flock cleaner, the material fed normally is supplied in the form of a lap or batt and the cleaned material is transferred (pneumatically) to the next machine in the blow-room line. In the card, the trash removal apparatus acts on fiber material presented in the form of a web, the degree of opening of the fiber material being much higher than of the fibers in fiber flocks. In the flock cleaner the material still has a certain degree of cohesion, which on the card has disappeared or, at least, is much lower.

The present invention deals with trash removal apparatuses or fiber cleaning aggregates respectively, for the flock cleaning stage, at which the material to be cleaned has not yet been opened down to the individual fiber, as well as for the card where the material is presented in the form of a web consisting of fiber material opened down to the individual fiber. The present invention is laid out specifically for application in a new cleaning module according to EP-A-810 309 in which this module is arranged in a card feed chute. The present invention also could be applied, however, in an otherwise conventional flock cleaner or on a card.

A typical conventional trash removal device applied on a card is explained in the following with reference to the FIG. 1 and thus a discussion of the state of the art can be dispensed with here.

Flock cleaners with adjustable eliminating elements are shown in the following documents:

DE-A-27 12 650: proposes a cleaner with a plurality of rolls each of which is provided with a housing containing an elimination opening. Each elimination opening is coordinated to a separating edge and the separating edges are adjustably mounted to housing parts. The manner in which the adjustment is effected is not mentioned in DE-A-27 12 650.

EP-A-481 302: concerns an adjustable grid arrangement. The FIGS. 5 and 6 and the corresponding description reveal in detail the manner in which the adjustment of certain grid elements is effected. These Figures are also shown in the present application and a more detailed description thus can be dispensed with here.

EP-A-459 465: an essentially conventional cleaning device with separating knives is provided in which the knives, arranged in the upstream vicinity of the material outlet, are complemented with an adjustable separating surface.

U.S. Pat. No. 5,031,279: individually adjustable elements are provided on a common support member. The knives are to be set extending in substantially radial direction relative to a roll.

U.S. Pat. No. 4,805,268: a motor driven actuating device is provided for various adjustable elements. In this case, the radial setting of a knife as a whole, as well as the pivoting about an axle that coincides with the knife edge, are provided. In a further embodiment, a guide element is adjustable, but the separating knives are arranged fixedly.

Suction devices are mentioned in these documents, but none of them is shown in the corresponding Figures (FIG. 3 and FIG. 6).

In the state of the art, frequently "knives" are referred to as "blades". A "knife" usually comprises a blade, which can be adjusted relative to a rotating roll or drum. It is known also that a similar function can be effected by an edge, also referred to as "separating" or "eliminating" edge. This edge is formed by an element not necessarily designed as an adjustable "knife" but, for example, as a "grid bar". The present invention is applicable also in arrangements of this type. In order to avoid cumbersome repetitions in the description, the term separating element with an edge is to be understood to comprise the particular forms of a bar, knife or blade, respectively.

A fiber processing machine is known with a rotating roll or drum in which arrangement a fiber/air stream flows in a "working gap" provided between the circumference of the roll and a cover surrounding it. A separating element is provided in the cover. Separation selectivity is achieved in that the roll is provided with a clothing holding the fibers whereas trash particles, mostly heavier than the fibers, are shoved radially outward towards the cover where they can be deflected from the stream with the help of the separating element. The working gap generally extends substantially across the whole axial length (across the "working width") of the roll.

In a machine of this type, it is known at least from EP-A-481 302 and U.S. Pat. No. 4,805,268 that the angular position of a separating element is adjusted relative to the stream of material in order to influence the separating effect.

The present invention can be combined with the invention (the "earlier invention") according to EP-A-848 091 (the "earlier application").

The goal of the earlier invention is the improvement of the air flow management downstream from a separating element provided with a suction device. In an arrangement of this type, the nep formation induced by air turbulences in a fiber processing machine can be reduced. An improvement of the trash separation as such, however, also can be achieved.

Thus, the earlier invention thus provides a fiber processing machine with a separating element in which the fibers as well as the air are guided in a generally predetermined transporting direction past the element. Trash particles are then selectively eliminated from the fiber/air stream with the help of the element. The invention is characterized in that at least one measure is taken for influencing the air stream conditions in the zone downstream from the element. Said measure can be taken in such a manner that air turbulences downstream in the transporting direction from the element are limited or even eliminated.

The measure preferably consists in that the air eliminated via the element is at least partially replaced by freshly supplied air. The freshly supplied air expediently flows into the zone adjoining the element downstream, preferentially within a distance of less than 20 mm.

Preferentially, the arrangement is self-adjusting as to the inflowing air quantity, so that no application of blowing air is required. If the free flow cross-section area of the air inlet duct is chosen sufficiently large, then the required air stream is generated owing to a vacuum or below atmospheric pressure prevailing in the room downstream from the element.

The present invention advantageously can be applied in a module according to the Swiss patent application No. CH 1819/97 filed Jul. 30 1997. A module of this type comprises a transporting roll for a fiber/air stream and a plurality of trash eliminating devices distributed along the circumference of the roll in which each device comprises a separating element, an eliminating gap, and trash elimination device coordinated with the gap.

OBJECTS AND SUMMARY OF THE INVENTION

It is a principal object of the present invention to improve the efficiency of the known arrangements of trash removal apparatuses which form fiber cleaning aggregates.

Additional objects and advantages of the invention will be set forth in part in the following description, or may be obvious from the description, or may be learned through practice of the invention.

The present invention provides a trash removal apparatus suitable for application on a fiber/air stream. The apparatus comprises a separating element, which can be set and maintained at selectively chosen positions relative to the stream, and a trash eliminating device for the material deflected from the stream with the help of the separating element. The apparatus also comprises a guide element, which can be arranged in the transporting direction upstream from the separating element in which the position of the guide element can be adjusted transversely with respect to the transporting direction in order to correspondingly adapt the width of the working gap. The arrangement is laid out in such a manner that adjusting movements of the separating element are accompanied by predetermined movements of the guide element.

The apparatus can be arranged in such a manner that, by means of adjusting the position of the guide element, the width of the working gap can be narrowed and the separating element can be rotated in order to move the surface deflecting a part of the stream closer to an imagined plane that substantially extends radially. The inverse setting operation also is possible. Setting means for the separating element and for the guide element can be linked, or combined, respectively, in such a manner that a given adjustment movement of the separating element is accompanied by a corresponding movement of the guide element and vice versa. A mechanical connecting link, however, is not necessarily required as the desired effect possibly can be achieved by providing a suitable control system for the adjustment actuating devices in which a controlled drive can be provided for each of the two elements. Care can be taken in any case that an adjustment of the position of the separating element, which results in a determined technological (removal) effect, is accompanied by an adjustment of the position of the guide element, which enhances that effect.

The term "accompanying" adjustment, thus within this context, does not necessarily imply simultaneous adjustment. The movements of the elements can be effected in sequence; the sequence is pre-programmed.

The separating element and the guide element both can be provided in the same trash removal apparatus, which is coordinated with a trash eliminating device.

The separating element can be arranged in such a manner that its penetration depth into the fiber/air stream can be adjusted. The preferred arrangement with adjustable penetration depth comprises a fiber cleaning aggregate provided with a plurality of thrash removal devices in which the separating element is provided in one device and the guide element arranged upstream is provided in a further device. The preferred arrangement is laid out particularly for application in a flock cleaner but it could be applied, e.g., in a fixed flat card as well.

Embodiments of the present invention are described in the sense of examples in the following with reference to the schematic drawings.

BRIEF DESCRIPTION OF THE DRAWINGS

FIGS. 9A–9E: FIG. 9A shows a diagram explaining the new adjustment principles in a second variant, where in the FIGS. 9B, C, D and E the flow patterns are shown schematically for various settings in the arrangement according to FIG. 9A;

DETAILED DESCRIPTION

Reference will now be made in detail to the presently preferred embodiments of the invention, one or more examples of which are shown in the Figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
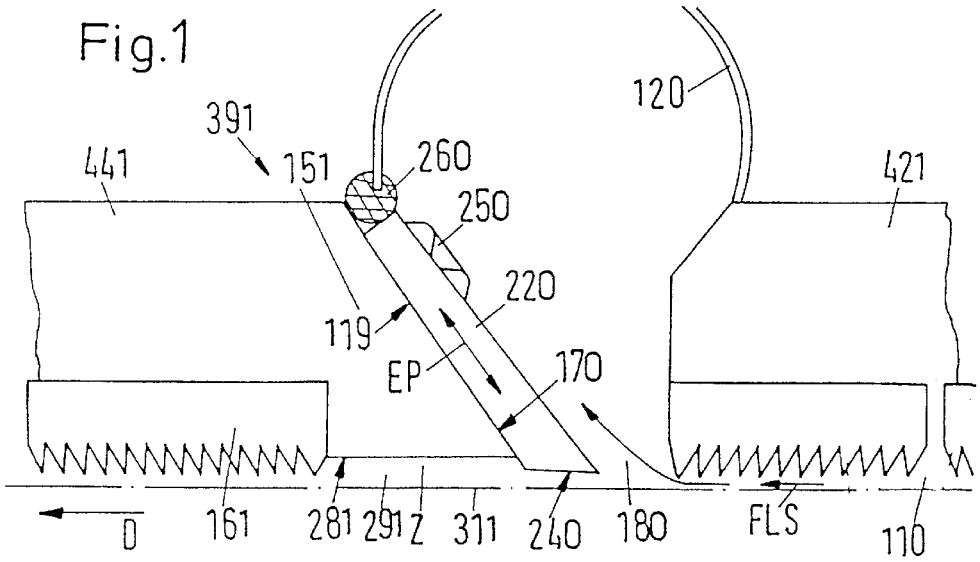
Fig.1 PRIOR ART
FIG. 1 shows a cross-section of a known device for application on a card.

In FIG. 1 a typical trash removal device or a trash removal aggregate 391 for application on a card is shown. In FIG. 1, the envelope surface or the beating circle of the main card drum is designated with the reference sign 311, the sense of rotation of the drum being indicated with the arrow D. The envelope surface 311 is defined by the clothing points which here are not shown as they are irrelevant for the explanation and well known to the expert in the field. The device 391 according to the FIG. 1 comprises a first cover segment 421 designed as a support member for further elements 161 provided with clothing. The working gap is indicated with the reference sign 110. An eliminating gap 180 between the segments 421 and 441 remains open and merges into the working gap 110. The eliminating gap 180 is covered by a hood 120 which at one end (not shown in the FIG. 1) is connected to a suitable elimination device in the form of a suction for carrying away the trash eliminated via the gap 180.

The second segment 441 is equipped with a knife 220 provided with a separating edge 240 protruding into the working gap. The knife 220 is fastened to an end portion 151 of the segment 441 by means of screws 250, one of which only is visible in the FIG. 1. The end portion 151 presents a contact surface 170 for a corresponding surface 119 on the knife 220. After release of the fastening screws 250, the knife 220 can be shifted in the directions indicated by the double arrow EP; the contact surfaces 170 and 119 sliding against each other. Thus, the position of the separating edge 240 relative to the envelope surface 311 can be adapted. The knife 220 also extends across the whole working width in which arrangement it is important that the position of the separating edge relative to the envelope surface 311 is set and maintained as equal as possible across the whole width. The hood 120 is pivotably hinged to the first segment 421 (the connecting means not being shown), and with its rubber gasket 260, presses against the face of the knife 220 distant from the separating edge 240.

The fiber/air stream FLS in the working gap 110 upstream from the edge 240 is determined by the circumferential speed and by the "surface roughness" of the main drum. The latter parameter, of course, is influenced by the characteristics of the clothing (not shown). The set position of the knife 220 relative to the envelope surface 311 (or rather relative to the clothing supported on the envelope surface) determines the "penetration depth" of the separating edge 240 into the stream FLS. This penetration depth determines the portion of the incoming fiber/air stream FLS, which is "peeled off" by the knife 220 and deflected into the eliminating gap 180, thus being removed from the working gap 110. The adjustability is important as the portion to be removed depends on the fiber material being processed and can not be predetermined once and for all in designing the machine. This general manner of functioning also applies for all further embodiments described in the following.

The penetration depth of the separating edge (the removed portion) is to be chosen such that the air layers "peeled off" carry a relatively high proportion of trash particles and possibly short fibers compared to few good fibers. In most cases, the separating edge 240 is set noticeably closer to the envelope surface 311 than is possible for the surface 281 of the segment 441. Therefore, the working gap 110 in the zone downstream from the separating edge 240 widens in the radial direction to a degree that depends on the current setting of the knife 220.

In the working gap downstream from the separating edge, the removed part of the stream is "missing" and the remaining portion of the stream must spread to fill the working gap. In the zone Z of the working gap adjoining the separating edge 240, a vacuum or below atmospheric pressure prevails which possibly pulls in somewhat more air loaded with trash particles between the separating edge 240 and the envelope surface 311 than is desired. Furthermore, the spreading air stream tends to develop a vortex formation at the separating edge 240, which results in turbulences in the zone 291 downstream from the separating edge 240. Such turbulences can cause "rolling" of fibers against each other that entangles the fibers, resulting in nep formation. Vortex formation also may occur in the working gap, which possibly returns air that includes trash particles into the working gap.

Figure 2:
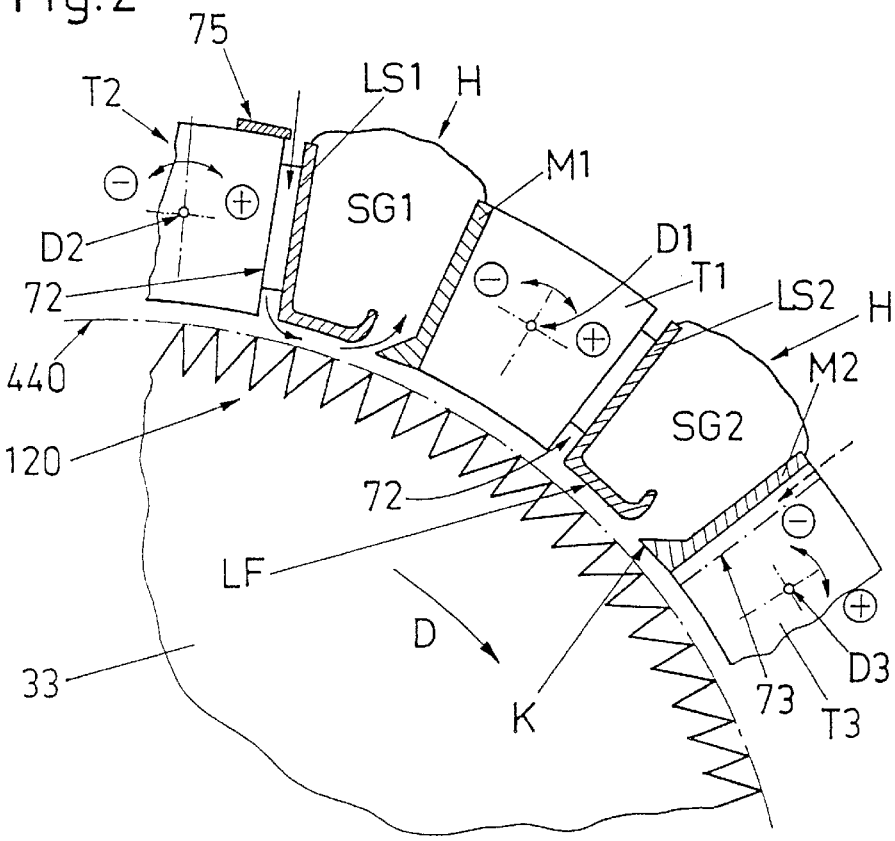
FIG. 2 shows a schematic view of a first embodiment according to a first variant of the present invention, the essential relations of which are shown at an enlarged scale in the FIG. 2A.

In FIG. 2, a portion is shown of an embodiment of a first variant of the present invention, which constitutes an improvement over the state of the art according to the FIG. 1. An opening roll indicated with the reference sign 33 is provided with a clothing 120 forming a beating circle or an envelope surface 440. A support member T1 supports a knife M1 as well as a guide rail (also called "catching rail") LS2. A support member T2 supports a further guide rail LS1 and a support member T3 supports a second knife M2.

Each one of the support members T1, T2, and T3 is mounted rotatable about a corresponding rotational axle D1, D2, and D3. The support members can be rotated jointly by a common actuating means (not shown) or can be rotated individually as indicated with the double arrows.

Each of the guide rails LS is provided with a guide surface LF and each knife M with an edge K. The elements shown, thus, together form two trash removal devices SG1 and SG2 each provided with a waste eliminating device, which in this case comprises a flexible hood H. If all support members are rotated simultaneously, e.g., clockwise, all elements M and LS are adjusted simultaneously. Similar devices can be provided. The description of the devices SG1, and SG2 is sufficient for the explanation of the further devices.

Figure 2A:
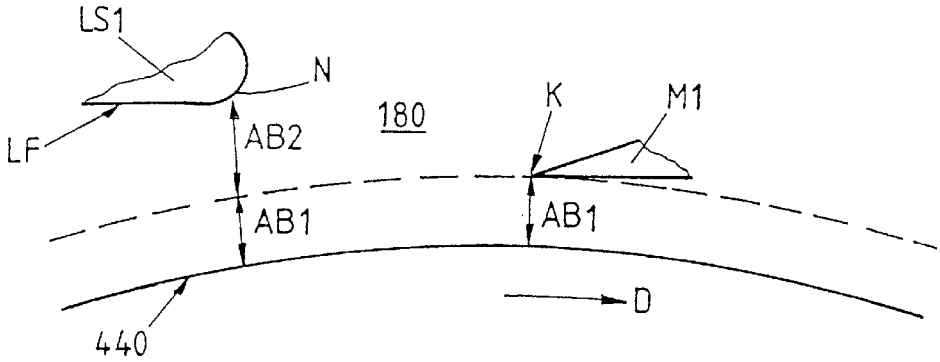

The essential relations in this arrangement are shown again in more detail and on a larger scale in the FIG. 2A. The same reference signs referring to the elements in FIG. 2 are also used in FIG. 2A. In the FIG. 2A, only the main elements of the device SG1 (with parts of the knife M1 and of the guide rail LS1) are shown; the description of the function, however, applies to all the other devices also. The radial working distance gap width AB1 between the separating edge K and the beating circle 440 can be selectively chosen. This gap width is varied as a function of the current angle position of the support member T1 relative to the rotational axle D1. If the support member T1 is rotated counterclockwise as shown in the FIG. 2, then the edge K penetrates deeper into the fiber/air stream and reduces the working distance or the gap width AB1, respectively.

As a function of the current value chosen of this edge working distance, the knife M, or the separating edge K respectively peels off a thicker or a thinner layer of air from the working gap.

The guide surface LF on the rail LS1 limits the spread of the stream FLS upstream from the eliminating gap 180. The action of the guide surface LF depends substantially on the value of the working distance chosen between the nose N that limits the gap 180 and the beating circle 440. This working distance can be separated into two "components" namely one component equal to the above mentioned working distance AB1 and an additional component AB2.

The effects of various adjustment movements of the elements shown now can be summarised as follows:

E1 An increase in the distance AB1 results in a decrease of the air quantity peeled off (at a given air flow speed) as the thickness of the air layer peeled off is reduced;

E2 Inversely, a decrease in the distance AB1 results in an increase of the air quantity peeled off;

E3 An increase in the additional distance AB2 results in an increase of the air quantity peeled off; and E4 A decrease in the additional distance AB2 results in a decrease of the air quantity peeled off.

As the thickness of the air layer peeled off (the air quantity peeled off) increases, the quantity of the trash particles and short fibers eliminated increases as the outer air layer peeled off carries a relatively high percentage of such material.

The arrangement, according to the FIG. 2, is laid out in such a manner that an adjustment in the angle position of a support member T effects a change in the position of a knife, as well as in the position of a guide rail, so that the resulting eliminating effects assist each other. In other words, they both act either in the sense of an increase or both in the sense of a decrease of the trash quantity removed. Expressed in other words, an adjustment movement E1 always is tied in with an adjustment movement E4, and an adjustment movement E2 is always tied in with an adjustment movement E3, owing to the common support member T. The changes resulting from the adjustment movement of only one support member T generate their separating effects not in the same device but in subsequent devices. For example, the support member T1 supports the knife M1 for the device SG1 and also the guide rail LS2 for the device SG2. The support members T1, T2, T3, etc., thus, are to be rotated all in the same sense. The reasons for this arrangement can be explained with reference to an embodiment according to the earlier invention, which will be discussed in the following with reference to the FIGS. 3 and 4.

Figure 3:
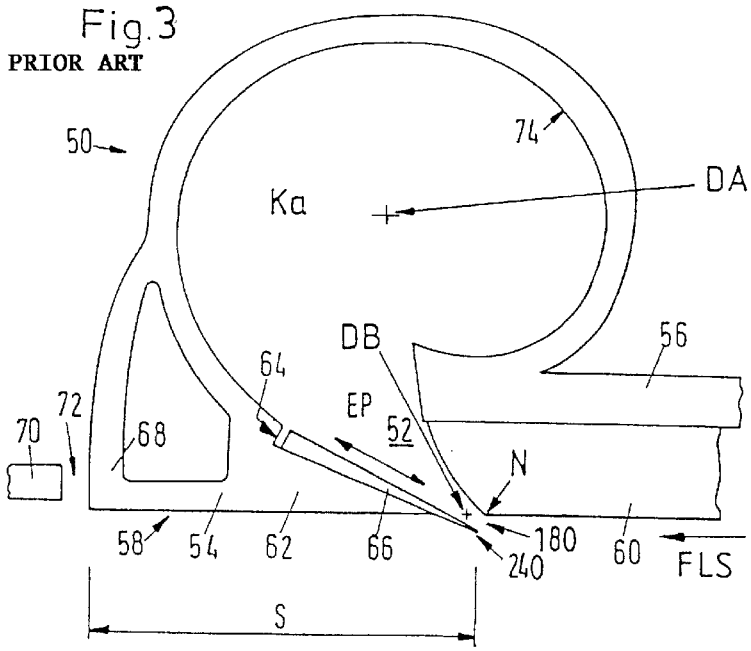
Fig.3 PRIOR ART
FIG. 3 shows a section of an arrangement according to the earlier invention (EP-A-848 091)

The apparatus, according to the FIG. 3, is laid out according to the earlier invention (compare EP-A-848091) and represents a further development of the apparatus according to the FIG. 1. A profiled element 50, made, for example, from hard anodized aluminum or from steel, extends across the whole working width. It is provided with a longitudinal duct Ka, as well as with an opening 52, which forms the separating gap 180. The profiled element 50 also comprises two cover elements 54 and 56 of which the element 54 is provided with a guide surface 58, which together with the drum (not shown in the FIG. 3, compare the beating circle 311 according to the FIG. 1), limits the working gap. The second cover element 56 serves as a support member for a guide element 60, which is mounted interchangeably to the support element in such a manner that, after installation it faces the drum or its clothing, respectively.

The wall portion 62, tapering off between the surface 58 and the opening 52, is provided with a recess 64 taking up a knife blade 66. Fastening means (not shown) are provided in such a manner that the separating edge 240 on the blade 66 can be adjustably positioned in the directions indicated by the double arrow EP relative to the working gap. The air deflected from the working gap by the blade 66 is replaced at the end of the guide surface 58, distant from the edge 240. Between the wall 68 of the profiled element 50 and the neighboring cover element 70 an air inlet opening 72 remains free, which during operation connects the working gap with the surrounding room outside the cover. The distance S from the opening 72 to the edge 240 preferentially is less than 50 mm. The opening 72, of course, is shaped as a "slot" in such a manner that the opening extends across the whole working width. The element 70 and the profiled element 50 can be mounted to the lateral drum shields.

The guide surface 58 is to be designed to be set close to the beating circle in such a manner that no significant turbulence is generated in the fiber/air stream remaining in the working gap downstream from the edge 240. For this purpose the surface 58 advantageously can be set very close to the drum so that no noticeable spread of the stream occurs downstream from the edge 240. Thus, a pressure drop in the working gap at or downstream from the edge 240 can be substantially prevented. If suitable pressure conditions can be maintained at the edge 240, then a feedback of air from the opening 180 can be prevented. It also proves possible to adjust the portion of the fiber/air stream to be "peeled off" more precisely by setting the blade 66. Without this measure, an air circulation can be generated under unfavourable conditions within the opening 52, and trash particles can reach the working gap again.

According to an advantageous variant of the present invention, the inner surface 74 of the profiled element 50 is designed in such a manner that the air carried off generally enters the longitudinal duct Ka tangentially and then follows the inner surface 74 and is guided into the zone at the center of the longitudinal duct. In this arrangement, a spiral air flow is generated including the trash particles and fibers carried therein as shown schematically in the FIG. 4. Elimination is effected using a suction device preferentially from the center zone at one end AE (FIG. 4) of the duct Ka. Air is fed at the other end ZE into the center zone of the duct Ka. In this manner, substantially constant take-up conditions can be maintained at the eliminating gap.

Preferably, no compressed air is applied, but rather the vacuum or below atmospheric pressure prevailing in the working gap is used for drawing in "replacement air" via the opening 72. The system thus is self-adjusting—as much air is sucked in as is required to avoid development of a substantial vacuum or below atmospheric pressure. The below atmospheric pressure zone, therefore, is connected via a suitable connecting duct with a source of air.

Figure 4:
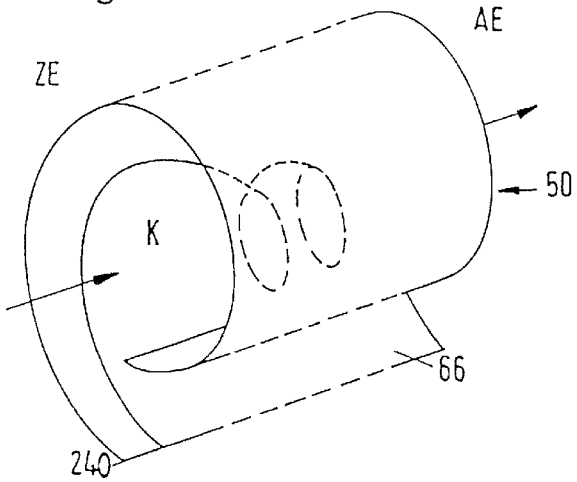
FIG. 4 shows a schematic isometric view of the preferred suction arrangement in a device according to the FIG. 3.

The earlier invention, particularly the embodiment according to the FIGS. 3 and 4, permits very close settings of the edge 240, or of the surface 58 relative to the points of the clothing on the drum. For example, the distance of the edge 240 from the clothing points can be in the range of 0.25 to 0.5 mm, and the distance of the surface 58 from the clothing points can be 0.8 mm.

The air supply, according to the earlier invention, also is provided in the embodiment according to the FIG. 2. In this case, between each support member T and the corresponding guide rail LS, a duct 72 is provided which is connected with the surrounding room as well as with the working gap. The arrangement of the rail LS on the support member T is to be laid out correspondingly, examples of solutions being described in the earlier application. Adjustable means also can be provided, e.g., a damper 75, for controlling the quantity of air fed in via the duct 72. The distance between an air deflecting edge K and the air inlet 72 arranged subsequently, thus depends on the dimensions of the support members T. If these dimensions are undesirable (e.g. too large) then each support member T can be provided with air inlet ducts 73 (indicated with broken lines) in such a manner that replacement air is fed into the working gap practically immediately upon the peeling off of an air layer by means of the preceding edge K.

From FIG. 2, it also can be seen that where a plurality of devices are arranged in sequence, the air supply downstream from an edge represents an air supply upstream from the next following air removing edge K. This effect is indicated in particular for the device SG1. The air flowing in between the rail LS1 and the support member T2 can escape from the working gap via the eliminating gap of the device SG1, i.e., it can be peeled off by the edge K of the knife M1. This air portion serves as "flushing" air and helps in carrying the trash away. By suitably designing the guide surface LF of each guide rail LS, a laminar flow pattern can be ensured between a duct 72 and the eliminating gap arranged subsequently to it.

In principle, it is possible to re-adjust a device according to the FIG. 3 also by means of rotational movements according to the present invention. The profiled element 50 could be provided with a rotational axle in such a manner that adjustment of the knife 66 in the directions of the arrows EP (FIG. 2) can be substituted or at least assisted by rotation of the profiled element 50 about the rotational axis. An arrangement of this type seems to be indicated in U.S. Pat. No. 4,797,980 (column 2, lines 6 through 12) even if no example of a device of such type is shown in the US patent. In the US patent, two components are mentioned seemingly referring to the knife and the housing. From U.S. Pat. No. 4,797,980, it is not clear whether, or in which manner, a guide surface should be adjusted.

In any case, the position of the rotational axle relative to the elements to be adjusted is of decisive importance. If the rotational axle would be arranged at the center of the duct Ka (e.g. at the position DA in the FIG. 3) then the edges 240 and the nose N on the guide element 60 would be rotated jointly about the rotational axle in the same rotational direction (clockwise or counterclockwise) towards, or away from the beating circle, respectively. Thus, an enlargement (e.g.) of the width of the working gap formed by the edge 240 thus would be accompanied by an enlargement of the width of the working gap formed by the nose N. These two adjusting movements result in opposite technological (separating) effects; i.e., technologically, they cancel each other partially.

In order to adapt the arrangement according to the FIG. 3 to the present invention using a rotational axle, the rotational axle would have to be arranged at the position DB in the FIG. 3, or somewhere on a connecting line between the edge 240 and the nose N. This could be realized on a card only with considerable design efforts, particularly as the width of the eliminating gap 180 in a card is relatively small. It thus proves difficult to adjust both elements of a single trash removal device for achieving a mutually assisting effect by means of a rotational axle. It would be possible, however, to provide an actuating device for a device according to FIG. 3 which moves the two essential elements in a coordinated linear movement in order to generate the desired effects that assist each other mutually.

The embodiment according to the FIG. 2 avoids this problem in an arrangement in which the knife of a preceding device SG1 is interconnected with the guide rail LS2 of the subsequent device SG2 through the common support member T1. The distance between the knife M1 and the guide rail LS2 is so large that the rotational axle D1 is not required to be positioned directly on a straight line between the edge of the knife M1 and the nose of the rail LS2. The devices SG1, SG2 etc. should be adjusted in a co-ordinated manner if the desired combined effect is to be achieved.

Figure 5A:
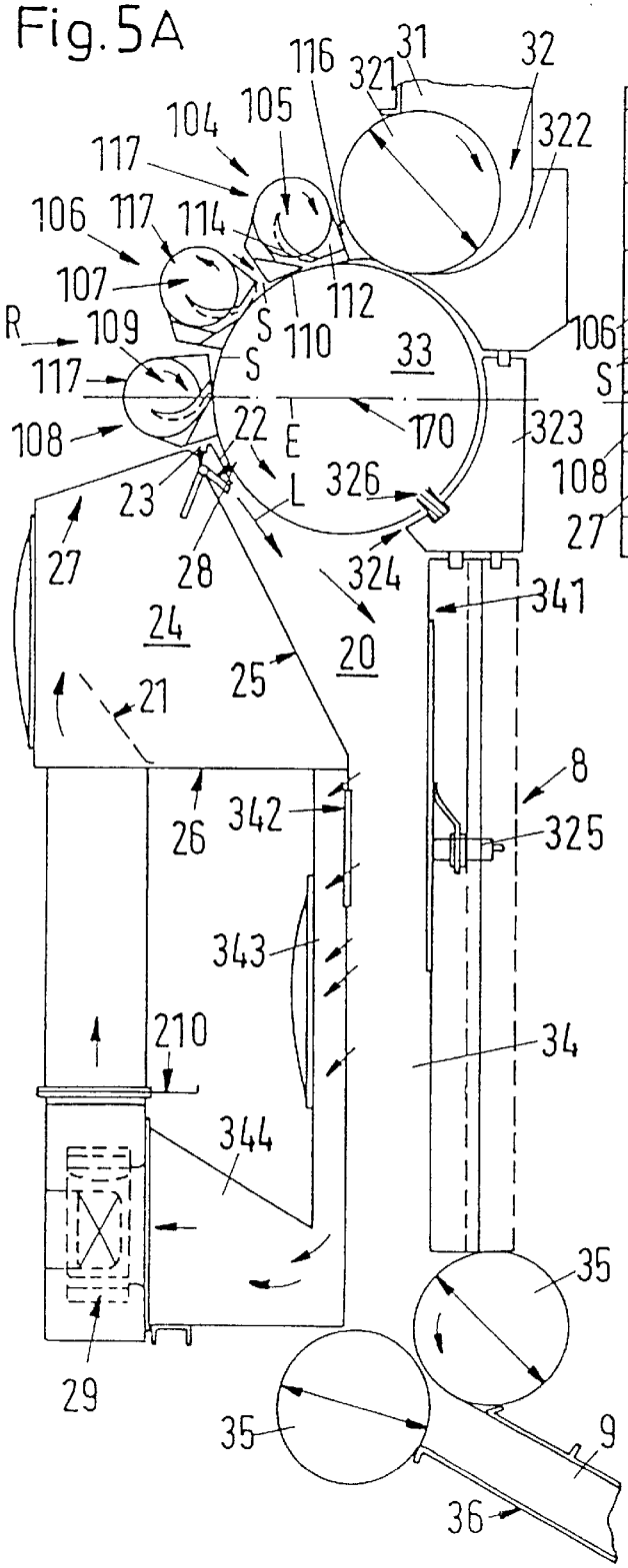
FIGS. 5A and 5B are copies of the FIGS. 3A and 3B from Swiss Patent Application No. 1819/97 filed Jul. 30, 1997.
Figure 5B:
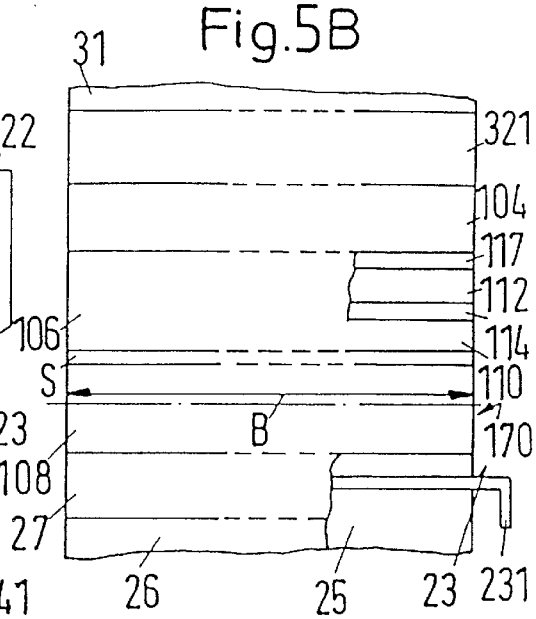

The observations stated thus far were explained with reference to the card. The arrangement according to the FIG. 2 could be applied in a so-called fixed flat card (e.g. according to DE-Gbm-94 19 619.2). The present invention, also in the embodiment according to the FIG. 2, is provided mainly for application in flock cleaners as will be explained in the following with reference to the FIGS. 5 and 6. In FIGS. 5A and 5B, the flock cleaner according to CH 1819/97 filed Jul. 30, 1997 is shown.

In FIG. 5A, the essential elements of a new card feed chute 8 are shown with a cleaning module in a cross-section. In particular, the upper portion of the chute or the supply chute 31, the lower chute portion or the reserve chute 34 with transporting rolls 35, the material supply arrangement 32 with a feed roll 321 and a feed trough 322, and an opening roll 33 are shown. A filling height level sensor 325 also is shown in the FIG. 5A. The lap or batt 9 supplied by the rolls 35 according to the FIG. 5A is carried on through a duct 36 to the feed roll (not shown) of the card. The side view (FIG. 5B) shows the cleaning module of the same chute as seen in the direction of the arrow R (FIG. 5A) in which arrangement in FIG. 5B certain elements are shown cut away in order to render the elements arranged behind visible also. The length of the roll 33 determines the working width B of the machine. This working width can range from 1 to 2 m, preferentially from 1 to 1.5 m. The supply arrangement 32 must be able to supply flocks distributed as uniformly as possible across the working width B to the roll 33. The material cleaned is to be distributed as uniformly as possible across the width of the chute portion 34. The rolls 321 and 33 are rotatably mounted into side walls (not shown) in which they are supported. The rotational axle of the roll 33 is indicated with the reference sign 170. The directions of rotation each are indicated by arrows.

The opening roll 33 provided with a clothing, preferably in the form of a needled roll functions as a transporting roll which transports the fiber material between the material supply arrangement 32 and the lap-forming device 34 and 35. Seen in the direction of rotation of this transporting roll, the "transfer point" where the roll 33 takes over fiber material from the fiber fringe presented by the supply arrangement, somewhat before the highest point on the transporting path is reached. The fiber material is carried past three removal devices 104, 106 and 108 and subsequently reaches a deflection zone 20 at the upper end of the lower chute portion 34. The removal devices 104, 106 and 108 are of substantially equal design in such a manner that the description of the device 104 can be considered applicable also to the two other devices 106 and 108. Each of the removal devices thus comprises a respective separating element 110 and a guide element 112 preceding it as seen in the transporting direction. Between the guide element 112 and the separating element 110 co-ordinated to it the mouth of an eliminating gap 114 is located. The three devices 104, 106 and 108 together form a fiber cleaning aggregate. A preferred embodiment of this aggregate in a first variant according to the present invention is described in the following with reference to the FIG. 6, after completion of the discussion of the general arrangement.

From FIG. 5A, it can be seen that the first removal device 104 follows upon the feed roll 321 practically "immediately". Between the feed roll 321 and this first removal device 104, just a guide bar 116 is arranged in the form of a transverse member, which guides the material taken over by the opening roll 33 into the working gap between the first guide element 112 and the transporting roll. Only a small distance is present between a preceding device 104, or 106 respectively, and the subsequent device 106, or 108 respectively. The leading edge of the last removal device 110, thus, is located in a horizontal plane E comprising the rotational axle 170 of the roll 33. This "geometry" is not necessarily required. The "plane E" could, for example, be shifted further in the direction of rotation of the roll 33 e.g. in such a manner that it forms an angle of about 45° with the horizontal plane shown.

The cleaning action is effected only partially "above" the roll 33, i.e., above the horizontal plane E shown. Gravity correspondingly assists neither the trash separating action nor the trash eliminating action. Each of the devices 104, 106 and 108, thus preferentially comprises its own trash eliminating device, which ensures that the material eliminated by the respective element 110 is removed from the transporting path. The material to be carried away moves into the gap mouth and in the gap portion adjoining it in a direction extending substantially tangential relative to the roll 33. Preferably, this material is deflected as soon as possible in a direction extending about parallel to the rotational axle 170, at least until it reaches either one of the sides of the machine. As gravity is not assisting, trash removal can be effected with the help of an air flow, and each of the devices 104, 106 and 108 preferentially is equipped with its own suction removal tube 117, extending parallel to the axle 170 across the working width. The individual tubes 117 on one machine side can be connected to a common suction duct (not shown). The connection can be established according to the principles explained for the card in EP-B-340 458 and EP-B-583 219. An alternative arrangement can be found in U.S. Pat. No. 5,255,415.

Using three removal devices 104, 106 and 108, it is possible to achieve a sufficient degree of cleaning of the supply lap 9 also if (according to EP-A-810 309) in the blowroom, no fine cleaning action (with a nip feed arrangement) has been effected. By shifting the plane E as mentioned above in the direction of transport room could be made available for a fourth removal device. The fiber material still moving with the roll 33 beyond the cleaning action after passing the leading edge of the last removal device 110 then can be prepared for the deflection, or to be dropped into the reserve chute 34, respectively. For this purpose, the material first is guided into close vicinity of the envelope surface of the roll 33, provided with clothing, in which arrangement the material stream tends to fly off tangentially from the roll 33 in a direction inclined downward. This inclination can be assisted by an air steam L, which merges with the material stream seen in the direction of transport after the guide surface 22 and flows in the tangential direction. The air stream L flows past the points of the roll clothing or possibly between the outer ends of these points. A suitable means for determining the optimum flow direction is explained in more detail in the following.

The material stream in this manner is taken off from the roll 33 to the greatest extent and is guided into the material deflecting zone 20 converging towards the lower end. For the case of any fiber flocks sticking to the clothing of the roll 33, the cover 323 of the roll 33 arranged opposite the cleaning module is provided with a clearing edge 324 which can clear fiber flocks protruding from the clothing and deflect them into the zone 20. The cover 323 can be designed as a hollow profile formed e.g. by extrusion. The corresponding portion adjoins a neighboring trough portion not designated with a reference sign which forms the trough 322. The latter also can be designed as a hollow profile.

The cover 323 is provided also with a brush protruding inwards in such a manner that individual fibers clinging to, or embedded in, the clothing can be eliminated and deflected into the zone 20 before the corresponding portion of the working surface provided with clothing reaches the nip point of the supply arrangement 32 again. The brush 326 comprises, e.g., a support bar which is taken up in the cover 323 in which arrangement the bar is provided with bristles extending inward. A brush of this type easily can be exchanged occasionally as a replaceable item. The brush serves not primarily for dropping flocks, but rather for sealing the gap between the roll 33 and the cover 323. In this manner, upstream from the brush a pressure builds which also assists in deflecting the fiber/air stream towards the lower chute portion 34.

Said air stream L flows from a calming room into a box 26 one wall 25 of which is arranged inclined in such a manner that it forms one side of the material deflecting zone 20. The side opposite to it of the zone 20, according to the FIG. 5A, is formed by a vertically arranged wall portion 341 extending upward to the cover 323 and downward adjoins one of the transporting rolls 35. The wall portion 341 is provided with an opening taking up the filling height sensor 325 but is not perforated and can be provided with a gasket against the cover 323. The air stream flowing into the chute portion 34, thus, can not escape on this side. The wall portion 341 can be arranged movably relative to the cover 323 in such a manner that the "depth" of the chute portion 34 can be adjusted in a horizontal direction at right angles to the working width.

The uppermost edge of the wall 25 (seen from the axle 170) is arranged behind a plate forming the guide surface 22. On this wall edge, a pivoting axle 23 is provided extending beyond the lateral walls of the machine (see the FIG. 5B) and provided with at least one adjusting lever 231. The axle 23 supports a wing 28 which together with the above mentioned plate forms an inlet duct for the air stream L. The plate itself is fixedly mounted relative to the roll 33 and is formed by a bent lip at the upper wall 27 of the box 26. By pivoting the wing 28, the width and the direction of the air stream L which forms a "curtain" can be influenced or optimized. The lever 231 can be operated manually or with the help of a controlled actuating device.

The air stream L is generated by a fan 29 and flows via a flap 21 into the calming room 24. The blowing air could be taken in from the surrounding room. In the preferred embodiment, however, it is taken in as recirculated air from the chute portion 34 via openings (not shown in detail) in a wall portion 342 which in the embodiment according to the FIG. 5A extends vertically down from the lower end of the wall 25 and faces the wall portion 341. As many "perforated" walls already are known for application in a lap-forming chute, a detailed description of the wall portion 342 can be dispensed. In the preferred solution, the perforated wall is designed as a sieve wall in which the wall can be composed of elements (lamellae). However the perforated wall is laid out, the air escaping from the chute portion 34 can be collected in a chamber 343 and guided down via an intermediate duct 344 to a fan 29. The air stream flowing through the fiber mass in the chute portion 34 serves for compacting the flocks collected therein, which action considerably improves the uniformity of the lap formed between the wall portions 341 and 342 and thus, also of the lap 9 delivered by the rolls 35.

The air quantity required can be determined empirically. The fan 29 preferentially is driven at a constant rotational speed by a motor which is not shown. The air quantity required can be set with the help of a baffle 210 or using the design of the flap 21.

The cleaning module, according to the FIG. 5, is not applicable to a card chute merely. The same principles of the solution can be applied to the layout of a "cleaning machine" to be used in a conventional blowroom line. Owing to an application in a fine cleaner, the use of a larger diameter opening roll will be feasible. Whereas the roll (needled roller) 33 can be of a diameter ranging from 250 to 300 mm, a fine cleaner should be provided with an opening roll of a diameter larger than 350 mm, e.g., of about 400 mm. The working width can be chosen in the range of 1 to 1.5 m, e.g., 1.2 m.

In a fine cleaner, it will be important that the circumference (the working surface) of the opening roll is made use of more intensely than it would be possible, or required respectively, in a feed chute. In the fine cleaner a much higher material throughput quantity is to be processed (currently 500 to 600 kg/h). On the other hand, dropping off of the fiber material is not required in this case as it is carried on by a pneumatic transporting system to the next machine in the blowroom line. The "exit" of the cleaning module to the transporting system thus can be provided substantially below the supply area, which saves free room along the lower half of the roll for further cleaning (e.g. removal devices No. 4, 5, and possibly 6). The cleaning elements provided along the lower half of the opening roll also can differ from the removal devices 104, 106 and 108 applied on the upper half of the roll, as along the lower half of the roll, gravity again plays a role in the removal of material, or in trash elimination, respectively.

In the FIG. 5A, it can be seen that the principles of air infeed according to the FIGS. 2 and 3 are implemented also in the new cleaning module, as the distances S between neighboring removal devices 104, 106 and 108 serve as air inlet openings, which are connected to the "surrounding room" in such a manner that they can introduce air from the surrounding room into the working gap. From the FIG. 5A, it also can be seen that the air infeed has been realised upstream from the separating gap. The distance S upstream from each removal device 106, 108, (as seen in the direction of transport) serves for introducing said "transporting air" for the subsequent device. For the device 104, air inlet openings are provided in the transverse member 116.

Figure 6:
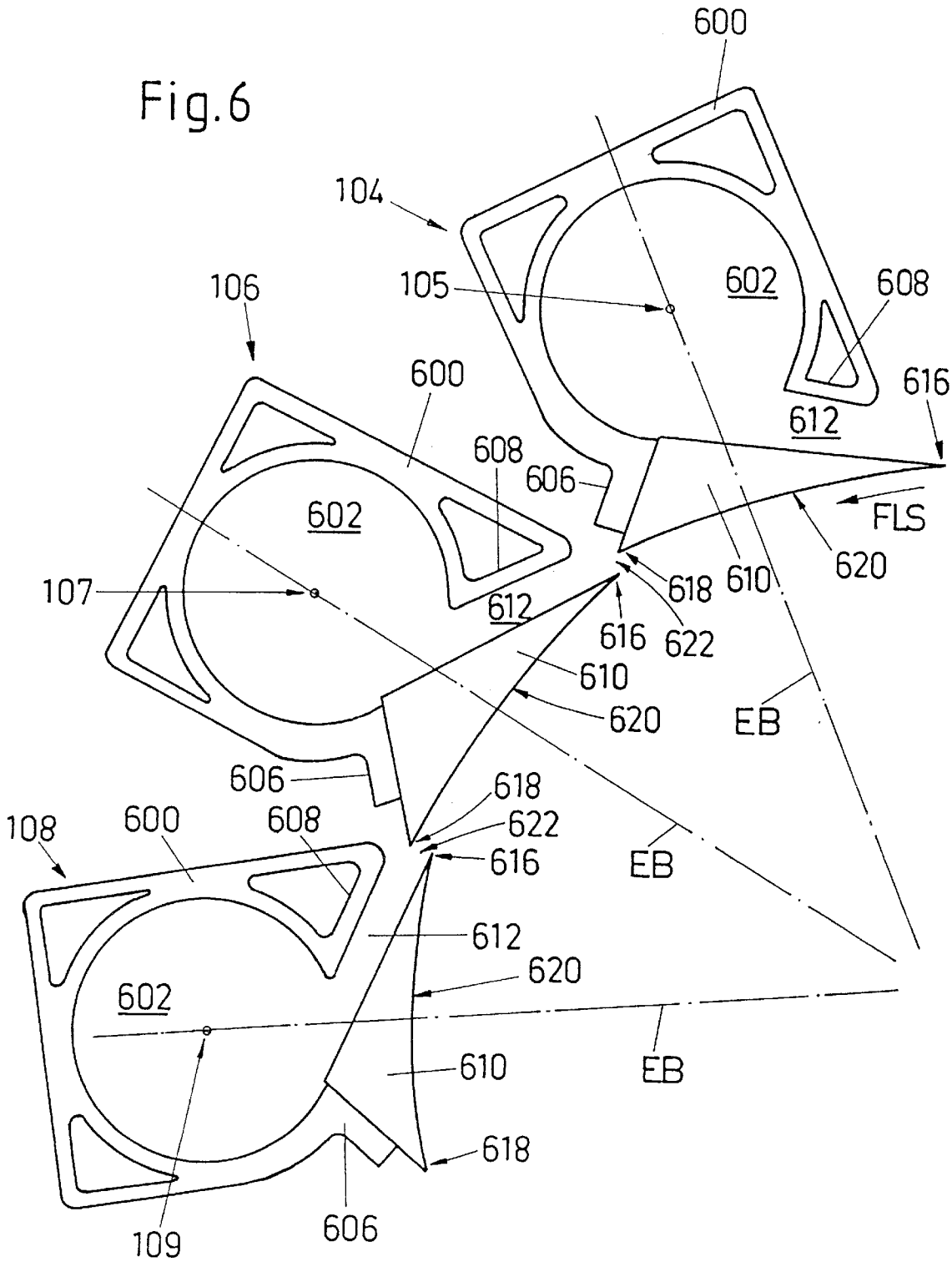
FIG. 6 shows a preferred embodiment of the first variant of the invention for application in a cleaning module according to the FIG. 5.

In FIG. 6, the preferred of a first variant of the fiber cleaning aggregate is shown for a cleaning module according to the FIG. 5. Each of the devices 104, 106 and 108 in this embodiment comprises a profiled element 600 which can be designed as an extruded profile. The transporting direction (flow direction of the fiber/air stream FLS) is indicated by an arrow. Each of the profiled members 600 is provided with a hollow portion 602, which forms the eliminating duct and is provided with two protrusions 606 and 608. The protrusion 606 forms a mounting surface for a working element 610 which is described in more detail in the following. The protrusion 608 forms one side of a guide duct 612 merging into the eliminating duct 602. The element 610 is rigidly mounted onto the protrusion 606 by means of screws.

Each working element 610 is designed as an elongated bar, the substantially triangular cross-section of which is uniform over the full length. The element 610 comprises at its front end (seen in the direction of transport) a separating edge 616, at the back end a nose 618 and arranged between these elements a guide surface 620 which during operation opposes the roll (not shown). The working elements 610 are arranged side by side in such a manner that they form a substantially continuous cover for the roll, an eliminating gap 622 each being formed between two neighboring elements. Each gap 622 merges into a respective duct 612.

The fiber cleaning aggregate according to the FIG. 6, thus, differs from the one shown in the FIG. 5 in that the individual separating and guide elements 110 and 112 in FIG. 5 are combined into a single working element 610 in FIG. 6. The guide surface 620 and the nose 618 for the device 106 correspondingly is supported in the device, or integrated therein, respectively, according to the FIG. 6.

The profiled elements 600 are supported in the machine frame in rotatory bearings and thus can be rotated each about its own rotational axle 105, 107 and 109 (compare the FIG. 5A). The arrangement is similar to the one shown in the FIG. 2 in so far as the rotational axle 105 is provided between the edge 616 of the device 104 and the nose 618 of the device 106. The rotational axle 107 is provided between the edge 616 of the device 106 and the nose of the device 108. As a profiled element 600 is rotated, the edge 616 and the nose 618 mounted thereon move in opposite directions which results in the desired mutually assisting effects though in neighboring devices. The devices thus must (as in the arrangement shown in the FIG. 2) be adjusted in a co-ordinated manner.

A plane EB comprising the rotational axle of the needled roll as well as one of the rotational axles 105, 107 and 109 intersects the corresponding guide surface 620 separating it into two parts. These parts can be of about equal length, which signifies that a pivoting motion of a profiled element 600 effects equal adjusting movements of the corresponding edge 616 and the nose 618, i. e., the change in penetration depth of the edge 616 corresponds about to the change in the working gap width defined by the nose. If one of the two setting movements is to be larger than the other one the position of the rotational axle of the corresponding profiled element can be shifted in such a manner that the plane EB divides the guide surface 620 into unequal parts.

The devices 104 and 106, 108 all can be connected via a lever mechanism to a common actuating device. This actuator device can be provided for manual operation or for automatic operation. The co-ordinated adjustment of all devices, therefore, is ensured by the lever mechanism. The same effect could be obtained, of course, using a programmable control system if the devices are not interconnected mechanically.

The arrangement can be integrated in a so-called VARIO-set system according to EP-A-452 676. In a system of that type, the rotational speed of the needled roll can be selectively chosen for adjusting the intensity of the fiber processing. A more intense processing action results in an improved cleaning effect, but also implies increased risk of fiber damage (shortening of fibers). The settings of the working elements 610 can be chosen selectively for influencing the trash removal. A deeper penetration depth of the edges 616 increases the trash quantity removed under increased risk of losses of good fibers.

Upstream from the first separating edge 616, a guide surface (not shown, but compare the element 116, FIG. 5A) is provided in order to ensure the transfer of the fiber material between the feed roll 321 and the first separating edge. The guide surface arranged upstream from the first separating edge preferably is set fixedly, but it also could be arranged adjustably, analogous to the other guide surfaces. The guide surface 620 downstream from the last separating edge 616 is adjusted in its position jointly with this edge, which as such does not effect anything as this guide surface is not followed by a further separating edge. The variable setting of the last guide surface, however, does not cause any disadvantages either but it permits identical design of the devices 104, 106 and 108 which advantageously facilitates logistics and the fitting process, respectively.

An embodiment for application in a cleaning module for a chute according to the FIG. 5 can be laid out in the following dimensions:

Diameter of the needled roll around 290 to 300 mm,

Pivoting angle of the individual profiled element around 5° to 20°,

Working gap width at the nose 618 between
a Minimum of 1 mm and
a Maximum of 4 mm, Working gap width at the edge 616 between
a Minimum of 1 mm and
a Maximum of 4 mm, Length of the guide surface 620 around 80 to 90 mm, preferentially about 85 mm, Width of the eliminating duct around 7 to 11 mm, preferentially 8 to 10 mm.

The adjustment movements are not necessarily effected by means of one single rotational movement or simultaneous rotational movement, respectively. An arrangement would be possible also in which one motor, each for a first portion with the edge 616 and a second portion with the nose 618, is provided in which both could be rotated or be moved linearly for effecting the adjustment movements. The actuator device could move these two elements simultaneously or consecutively. It is important, however, that the movements be co-ordinated (e.g. using a suitable control device) in order to achieve the effect desired.

Figure 7:
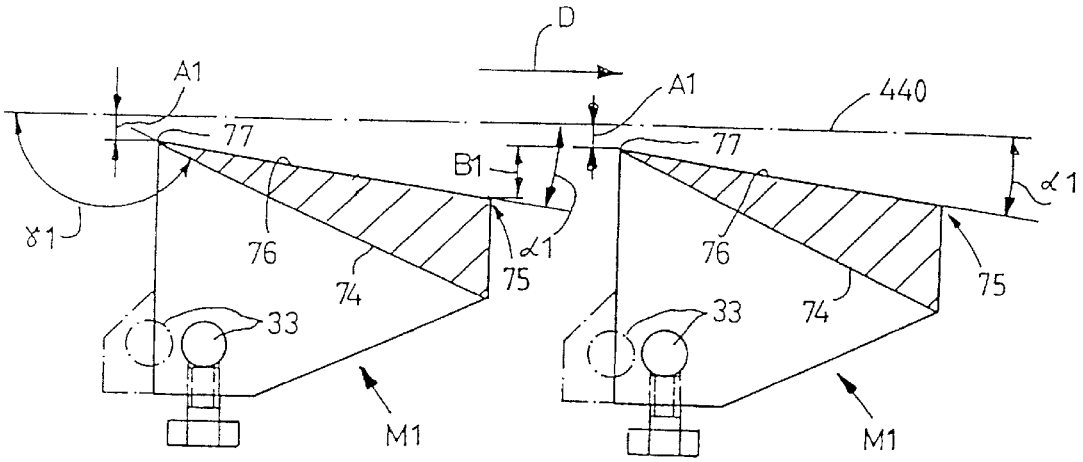
Fig.7 PRIOR ART
FIGS. 7 and 8 are copies of the FIGS. 5 and 6 from EP-A-481 302 cited above.
Figure 8:
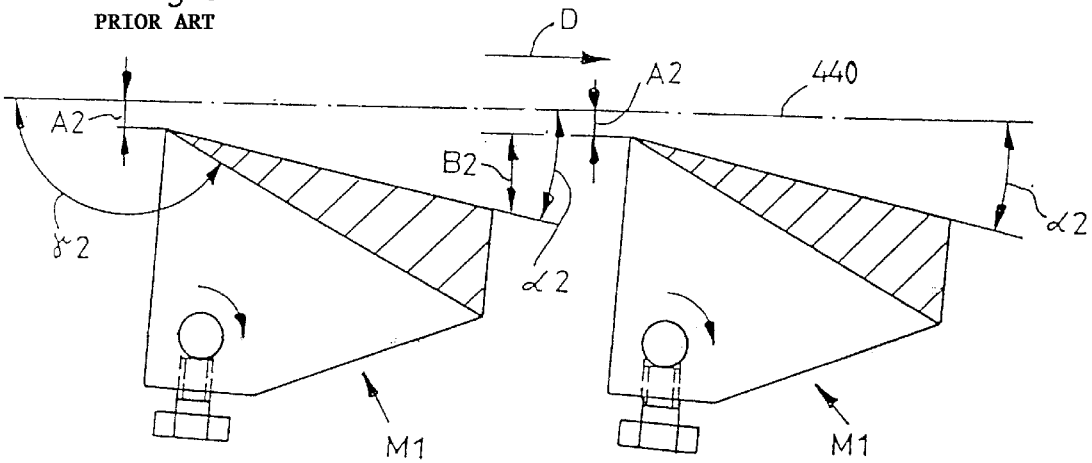
Fig.8 PRIOR ART

In FIGS. 7 and 8, two neighboring grid bar modules M1 each are shown of a grid arrangement for application in a flock cleaner (fine cleaner) according to EP-A-481 302. The beating circle of a clothing on a rotatable roll or drum is indicated simplified as a straight line. According to the description in EP-A-481 302, a "free angle" is enclosed between the beating circle 440 and a guide surface 76 at each module M1. Between the beating circle 440 and a "guide surface" 74 at each module M1, a "put angle" is formed. Using a suitable actuator device (not shown, compare EP-A-481 302), the grid bar modules M1 can be rotated about their respective pivoting axles 33 in order to increase the free angle from a value (1)(FIG. 7) to a value (2)(FIG. 8), or vice versa.

The location of the pivoting axle 33 in the zone of the left hand side of each grid bar module shown is arranged in such a manner that if the grid bar module is pivoted about the pivoting axle 33, then the distance B (i.e. the distance in the radial direction between the leading edge 77 of each module M1 and the end edge 75 of the preceding module) is enlarged from B1 to B2 (compare the FIG. 8). On the other hand, the distance A2 (between each leading edge 77 and the beating circle 440 as shown in the FIG. 8) is not markedly larger than the corresponding distance A1 in the FIG. 7. Therefore, the adjustment of the module M1 practically does not change this distance A1. Once set, the distance A1 thus is changed only negligibly by the pivoting action for adjusting the angles.

Experimental investigations on grid devices according to the FIGS. 7 and 8 now have yielded new findings not known hitherto. Pivoting of the "guide surface" 74 from the position according to the FIG. 7 into the position according to the FIG. 8 (decrease of the put angle) results in a reduction in the elimination, i.e., less material is removed between the grid bars. This effect was to be expected according to the theory of the grid. The corresponding widening of the working gap at the edge 75 from (A1+B1) as shown in the FIG. 7 to (A2+B2) as shown in the FIG. 8, which automatically must occur if the put angle ( is reduced in an arrangement according to the FIGS. 7 and 8, results in an increase in the elimination effect, i.e., more material is separated from the fiber/air stream. In other words, widening of the working gap upstream from the separating edge 77 partially offsets the influence of the decrease in the put angle. This fact was not known thus far.

The principle of this further embodiment of the present invention is based on the new findings mentioned and develops them still further.

The diagram shown in the FIG. 9A serves for explaining the new principles which can be realized in various embodiments of the invention. The line Q represents a "reference surface", which here for the sake of simplicity is shown as a plane, but which in practice can be curved, however (envelope surface of a rotatable roll, compare the straight line 440 in the FIGS. 7 and 8). The solid line AF represents a separating surface (similar to the guide surface 74 in the FIGS. 7 and 8) which at its leading end (near the reference surface) is provided with an edge K. The eliminating surface removes air deflected by the edge K from the working gap. The solid line LF represents a guide surface. The reference sign Q1 indicates an imagined plane extending parallel to the reference surface Q and intersecting the edge K.

The transport direction of the fiber/air stream is indicated by the arrow FLS which shows that the material stream first flows along the guide surface LF and then impacts the edge K. Between the guide surface LF and the edge K, an eliminating gap AS is located. The guide surface LF and the surface AF are adjustable in such a manner that the removal effect can be influenced. Suitable means for adjusting these surfaces will be explained in the following, but they are not playing a vital role in the explanation of the principles.

One adjustment possibility consists in that the angle position of the eliminating surface is adjusted relative to the reference surface Q (Q1), or relative to the fiber/air stream, for example, by shifting the surface AF into its position indicated with the dashed line (which corresponds to an increase in the "set angle" from 1 to 2). The position of the edge K remains substantially unchanged. Owing to this rotation of the surface AF, the removal effect is reduced. A thinner layer of air is peeled off the material stream and is deflected via the eliminating gap AS. This can be visualized from the FIG. 9B which is shown merely for explanation purposes without implying any restricting effect. In its extreme position according to the FIG. 9B, the surface AF acts as a stemming element with respect to the fiber/air stream flowing onto it in the working gap as indicated schematically by the "streamlines" in the FIG. 9B. Part of the stream is deflected anyhow and is eliminated via the gap AS, but a larger portion, compared to the one in the arrangement according to the FIG. 9C, now is guided around the edge K. Between edge K and the transporting roll (not shown) the fiber/air stream is compressed. In the arrangement according to the FIG. 9C everything remains unchanged except for the angle position of the surface AF which in this case corresponds to a very small value of the set angle. The edge K now acts as a separating element which (without exerting a noticeable stemming effect) eliminates compared to the arrangement shown in the FIG. 9B (a larger portion of the stream via the gap AS).

A further adjustment possibility consists in that the guide surface LF is shifted towards the reference surface Q in such a manner that the width of the gap FS adjacent to the eliminating gap AS is narrowed. This adjustment can be effected by shifting the guide surface into its position indicated with dashed lines (FIG. 9A) without a change in the angle position of the guide surface LF. The desired effect, however, could be achieved also in that the guide surface LF is pivoted about its leading edge VK. By reducing the width of the gap FS the removal effect also can be reduced. By inverting this adjustment movement, the removal effect, of course, is inversely influenced. These effects are shown again merely schematically and without any restricting effect in FIGS. 9D and 9E. In FIG. 9D, the arrangement is shown with a very large gap FS, and in FIG. 9E, with a very narrow gap. In the FIG. 9E arrangement all the other characteristics (in particular the angular position of the surface AF) relative to the arrangement shown in the FIG. 9D remain unchanged.

The "basic insight", thus, is that these two setting parameters each exert an influence, and that by suitably linking them various combinations can be effected. In particular, the adjustment movements can be linked in such a manner that the respective effects exerted by the elements involved reinforce or assist each other mutually. This finding also can be strengthened and intensified within the principles according to the "VARIOset" principles (compare EP-A-452 676).

The adjustment of the eliminating surface or surfaces and of the guide elements as shown can be applied to influence the quantity of trash removed. The rotational speed of the roll can be varied in order to increase or to decrease the intensity of fiber processing. These two effects can be mutually co-ordinated, or optimized respectively, with regard to the processing of a specific fiber material. Such co-ordination or optimization is facilitated in that the effect of the setting of the eliminating surface is assisted by the adjustment of the guide element (and is not partially off-set).

The set angle advantageously can be adjusted in the range between 20° and 40°, preferably between 25° and 35°. The distance FS advantageously can be adjusted between 0.5 mm and 10 mm, preferably between 1 mm and 5 mm where as a "reference surface" Q for determining the distance FS (the beating circle or the envelope surface) of the clothing supported on the transporting roll is chosen.

Figure 10A:
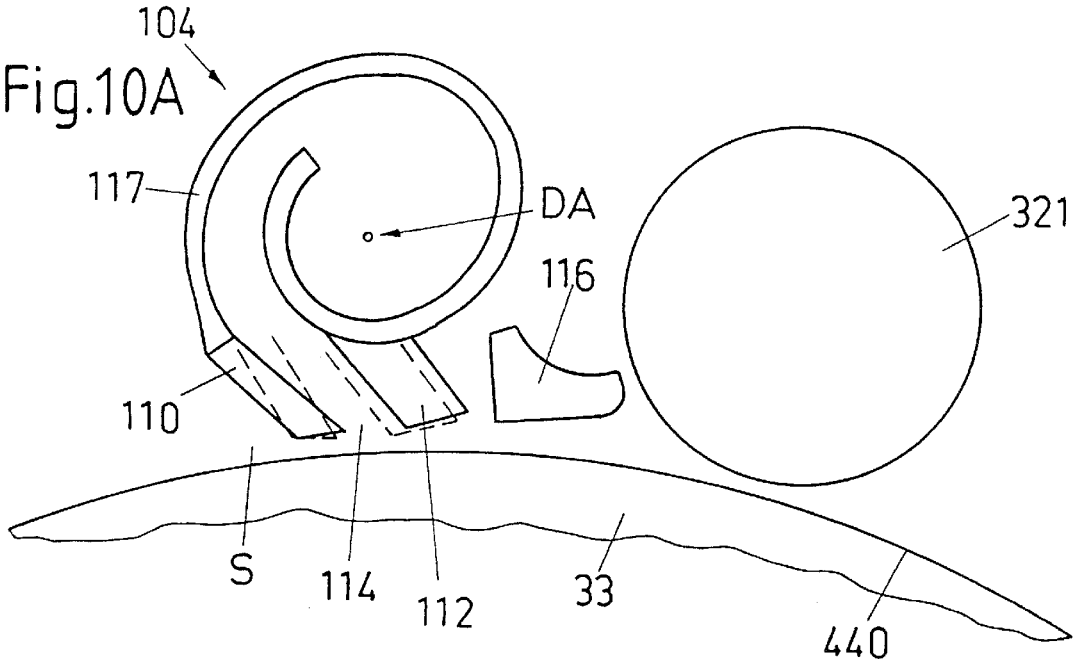
FIG. 10A and 10B show a removal device according to the second variant for the cleaning module according to the FIG. 5, shown at an enlarged scale, and in the FIG. 10C, a detail according to the FIG. 10A shown to a scale enlarged still further.
Figure 10B:
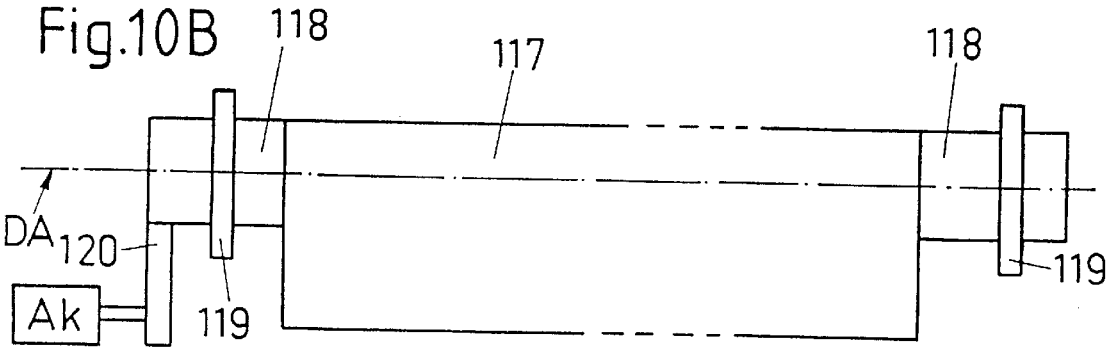
Figure 10C:
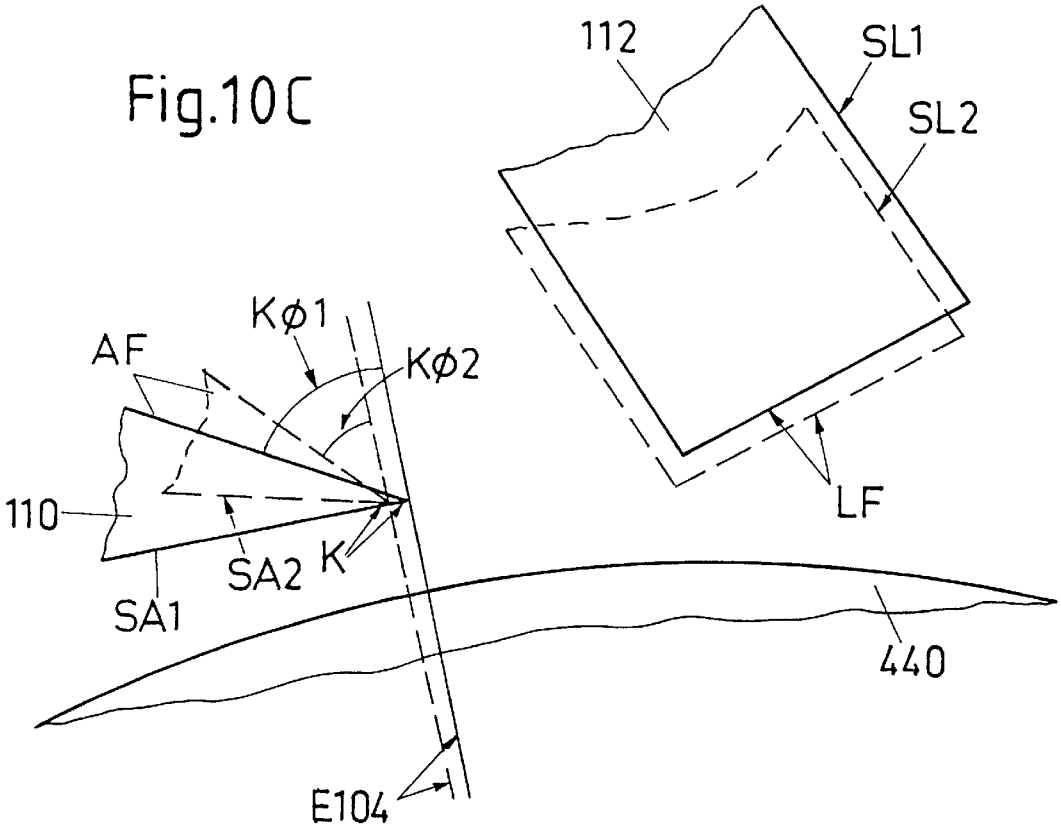
Figure 11:
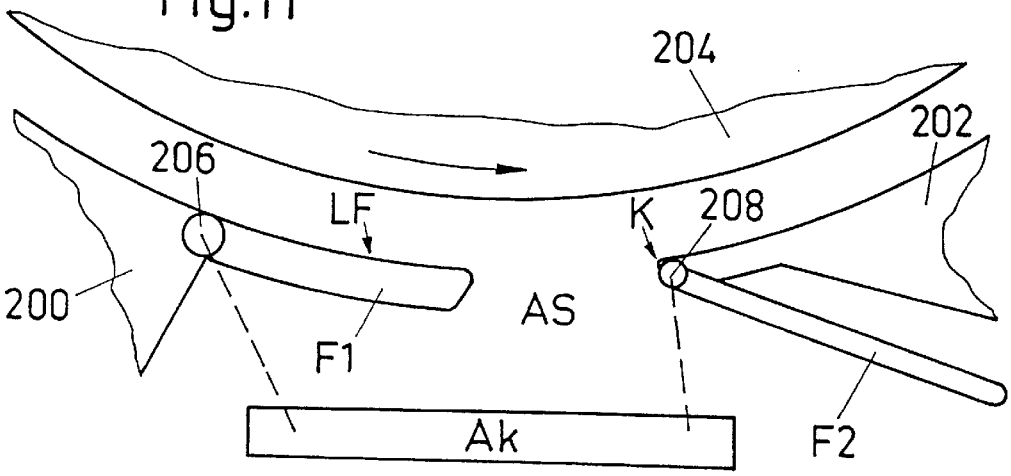
FIG. 11 shows a schematic view of an alternative arrangement for application in the blowroom (in a fine cleaner)

FIGS. 10 and 11 illustrate design examples of this further embodiment in which the principles according to the FIG. 9 are realized, namely in a module according to the FIGS. 5A and 5B.

In FIG. 10, the feed roll 321, the guide bar 116 and the first removal device with its guide element 112, the separating element 110, and the eliminating gap 114 are shown, as well as the beating circle 440 (the envelope surface) of the roll 33. The two elements 110 and 112 are rigidly mounted onto the housing 117 of the eliminating duct or are formed as a unit with it (e.g. as parts of an extruded profile).

At each end (FIG. 10B), the housing 117 is provided with an extension 118 supported in respective rotational bearings 119. The rotational bearings 119 are mounted into the lateral walls (not shown) of the machine in such a manner that they define a rotational axis DA (compare also the FIG. 10A) for the removal device 104. The left hand side extension 118 (FIG. 10B) is connected with an adjusting lever 120 which can be operated manually or using a controlled actuating device for effecting adjustments.

If the housing 117 is rotated clockwise (according to the FIG. 10A), then the elements 110 and 112 are shifted, e.g., from their positions indicated with solid lines into positions indicated with dashed lines. The changes are more clearly visible from the detailed illustration in the FIG. 10C where the reference signs AF, LF (compare the FIG. 9) are used again for the eliminating elements and guide elements.

If now an imagined plane E104 is defined which intersects the edge K of the element 110 as well as the rotational axis 170 of the roll 33 (FIG. 5A), then the angle K in FIG. 10C corresponds precisely enough to the complementary angle of the set angle in FIG. 9 where +K=90°. From FIG. 10C, it can be seen that the angle K between the surface AF and the plane E104 is reduced from K1 to K2, if the element is moved from its position SA1 (indicated with solid lines in the FIG. 10C) to its position SA2 (indicated with dashed lines), i.e., the set angle is increased correspondingly. As explained already with reference to FIG. 9, a change of this type results in a decrease of the removal effect.

Simultaneously, the element 112 is shifted from its position SL1 (indicated with solid lines in the FIG. 10C) to its position SL2 (indicated with dashed lines). Owing to this movement, the working gap between the guide surface LF and the beating circle 440 is narrowed, which also results in a reduced removal effect. The resulting effect of the movement of the element 112 thus assists or increases the effect of the movement of the element 110. As a small adjusting movement (compared to the arrangement according to the FIGS. 7 and 8) exerts a greater influence onto the removal of material, the machine can be adjusted more precisely. As the two elements 110 and 112 can be adjusted in one single adjustment movement, the solution shown is not only very cost-efficient but also is achieving consistently reproducible results. This embodiment of the present invention, however, is not restricted to the application described as will be explained in more detail with reference to FIG. 11.

From FIG. 10C, it can be seen that the position of the rotational axis DA in the suction chamber (FIG. 12) inevitably results in a small displacement of the edge K, if the element 110 is adjusted in its position, which displacement counteracts the effect of the change in the set angle ( (FIG. 9). The displacement of the edge K is so small, however, that its effect can be considered negligible. This negligible displacement can be ensured if the rotational axis 170 of the roll, the edge K, and the rotational axis DA are located in (or in close vicinity of) a single plane, which also holds true in the arrangement according to the FIG. 5 (compare the above mentioned plane E).

In FIG. 11, two cover elements 200 and 202 are shown for a roll 204 of an opening and cleaning machine in the blowroom or in the card room, e.g., of a fine cleaner or a licker-in. The reference sign AS again designates an eliminating gap. The reference sign F1 designates a first wing providing the guide surface LF in this variant. The wing F is mounted on the segment 200 rotatable about a rotational axle 206.

The reference sign F2 designates a second wing presenting an edge K. The wing F2 is mounted on the segment 202 rotatable about a rotational axle 208 which practically coincides with the edge K. The two rotational axles 206 and 208 can be connected to a common actuating device (schematically indicated as Ak) in which arrangement the transmission of the movement from the actuating device Ak to the rotational axles can be designed in such a manner that a movement of a motor in the actuating device Ak is transformed into various movements of the wings F1 and F2 (according to the FIG. 11).

Also, one actuating device each (Ak1, Ak2, not shown) for the two rotational axles 206 and 208 (wings F1, F2) could be provided which results in a most flexible (but more cost-intensive) arrangement. Of course the rotational axles also can be operated manually instead of with the help of a motor.

Figure 12:
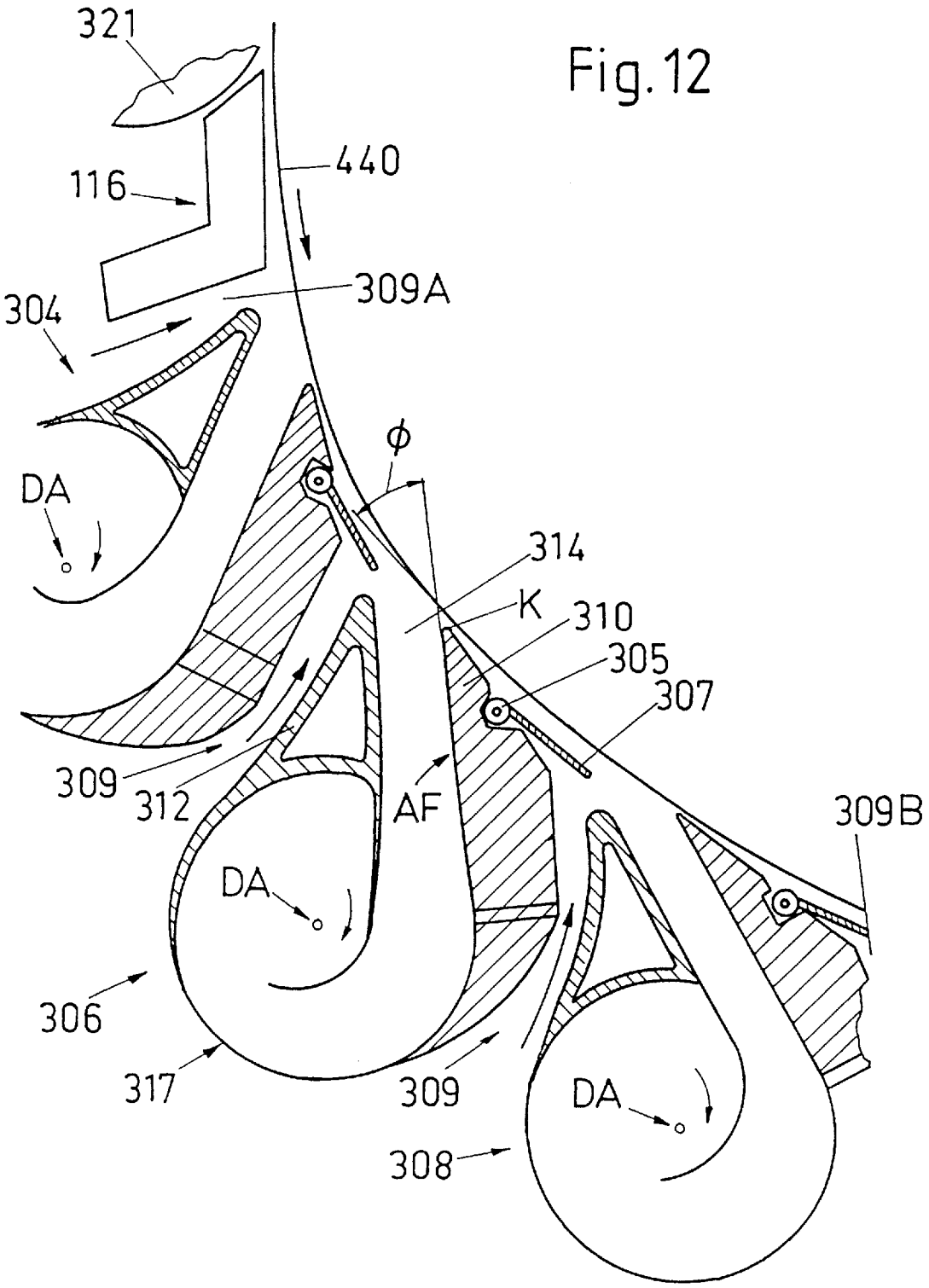
FIG. 12 shows a further development of the second variant of the present invention based on the combination with the earlier invention.

In FIG. 12, a further cleaning module is shown laid out according to the present invention as well as to the earlier invention (EP-A-848 091). In the FIG. 12 (as in FIG. 5A), a feed roll only shown partially is followed (seen in the direction of transport) by a transverse member 116 as well as the beating circle 440 of a transporting or opening roll (not shown in particular). The transverse member 116 is followed by three trash removal devices 304, 306, and 308; the device 304 only being shown partially. As these devices are substantially identical a description of the device 306 is representative also for the other two devices. Each of the devices comprises a tubular housing 317, an eliminating element and a nose 312, an eliminating gap 314 being provided between the nose 312 and the element 310. The nose 312 and the element 310 are fastened either on the housing 317 or are formed as a unit therewith. The whole arrangement is rotatable about a rotational axis DA (not shown, compare the FIG. 10B). The element 310 is provided with an edge K and also supports a rotational axle 305 for a guide wing 307, which is designed similar to the wing F1 (FIG. 11). The wing 307 partially covers an air inlet duct 309 between the nose 312 and the separating element of the preceding (seen in the flow direction) device. The duct 309 is connected to the "surrounding room" of the machine in such a manner that it can introduce air form the surrounding room into the working gap and the transporting gap respectively. A similar duct 309A is provided between the transverse member 116 and the first device 304 as well as a further duct 309B downstream from the last device 308.

The wings 307 deflect the air streams from the ducts 309 and 309B into the respective transporting direction. The wing 307 of the device 304 serves as a guide element for the device 306, and the wing 307 of the device 306 serves as a guide element for the device 308. As the last mentioned function already was mentioned with reference to FIG. 11 (for the wing F1), a repetition of the description is dispensed with here. It is to be stated, however, that in the variant according to FIG. 12, the set angle of the separating element 310 is adapted by rotation of the housing 317 about the rotational axle DA, whereas the distance between the free end of the wing 307 and the beating circle 440 is adjusted separately by rotation of the wing about the rotational axle 305. The set angle (compare the FIG. 9A) in this case is shown between an imagined extension of the separating surface of the element 310 and a tangent line of the beating circle 440, where the beating circle intersects the extension mentioned.

The guide bar (the transverse member) 116 to be provided upstream from the first device 304 is not provided with a guide wing, as this bar itself serves as a guide element for the first device 304. The adjustable angle position of the guide bar can be correspondingly chosen. The feed roll 321 or the feed trough (not shown) co-ordinated to the roll can be arranged movably supported in such a manner that it can adapt its position to the fiber mass clamped between these two elements.

The preferred embodiment of the second variant (FIG. 13) for each removal device 104, 106, and 108 comprises a profiled element 500 with a hollow room 502 forming the suction duct. The profiled elements each are rotatably supported about their respective longitudinal axes 105, 107, and 109 (compare the FIG. 5A). The profiled element 500 of the device 108 is provided with a longitudinal slot 504 merging into the hollow room 502 and forming the eliminating slot 114 (compare the FIG. 5). To one side of the slot 504, a pedestal 506 is arranged on which a shoe 508 is mounted by means of screws 510. The shoe 508 is provided with a protrusion 512 extending against the rotational direction of the roll 33, the leading end of which forms a separating edge. The shoe 508 with its protrusion 512 including the separating edge forms the separating element 110 (compare the FIG. 5) with an eliminating surface 513. The other profiled elements are formed identically and are provided each with a shoe in which arrangement the reference signs have been dispensed with for better clarity of the illustration.

To the other side of the slot 504 a longitudinal member 514 is provided with a surface 516 facing the transporting roll. The member 514 forms the guide element 112 (compare the FIG. 5A) and the surface 516 forms the guide surface for the fiber/air stream moving with the roll 33.

Figure 13:
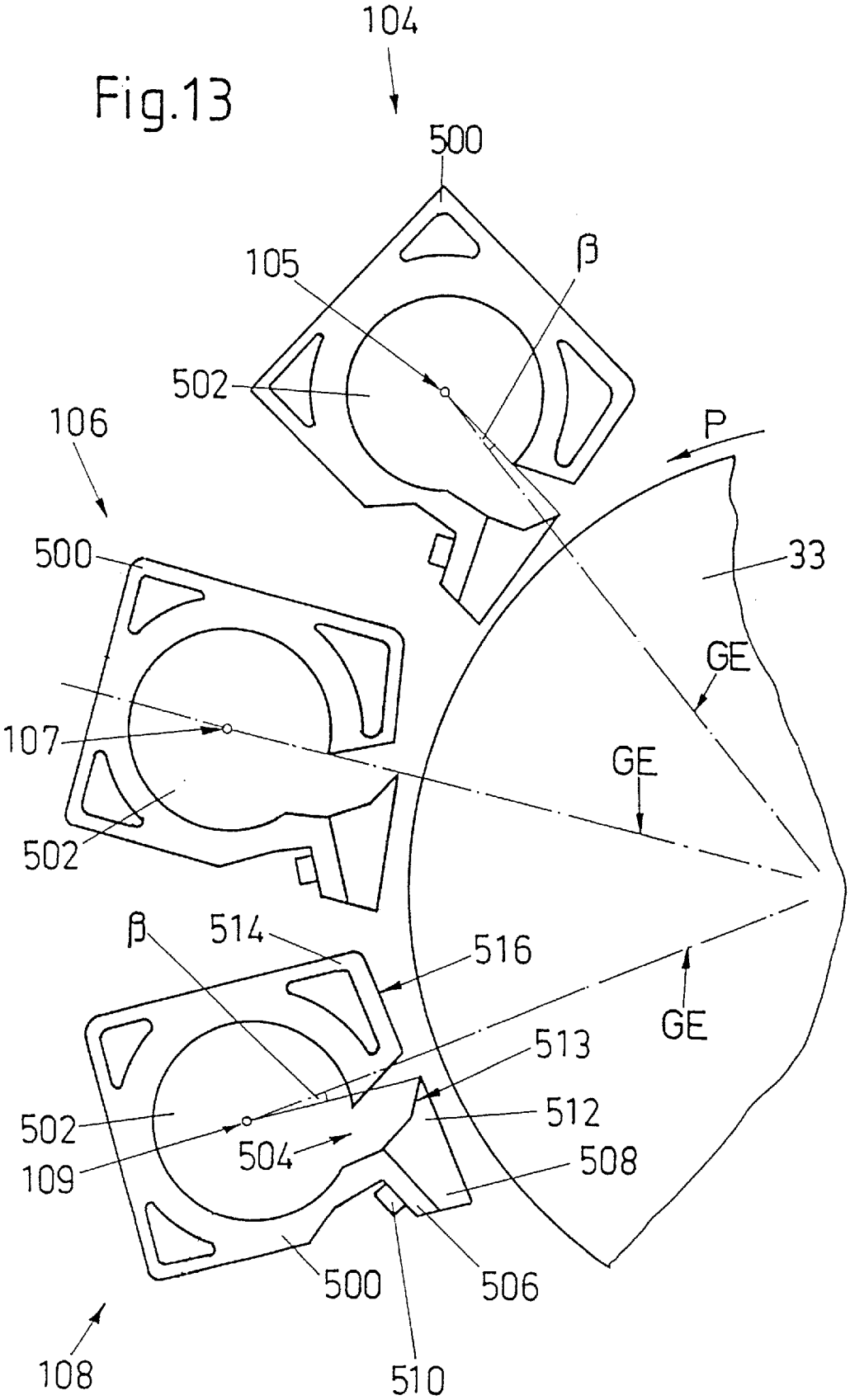
FIG. 13 shows a further embodiment of the second variant.

In FIG. 13, the three devices are shown each with a different setting, (angles B) which normally does not occur during operation, but which is helpful for illustration purposes here. The device 106 is shown in its medium (base) position in which the separating edge is located in a plane (base plane) GE which also comprises the rotational axis 107 of the device 106 and the rotational axis 170 of the roll 33 (compare the FIG. 5A). The device 104 is set in a position in which the separating edge of this device has been moved against the direction of rotation P of the roll 33 beyond the plane GE ("towards the front") which corresponds to a reduction of the angles (FIG. 9). This results in a relatively high removal effect compared to the one achieved in the base position shown for the device 106.

The device 108, on the other hand, is set in a position in which the connecting plane (connecting the rotational axis 109 with the separating edge) is arranged "behind" the base plane GE (seen in the direction of rotation P). This corresponds to an increase in the angles mentioned above, which corresponds to a decrease in the removal effect (compared to the one achieved in the base position).

In FIG. 13, it is shown that the change in the angle position illustrated by the separating surface 513 can be effected by rotation of the profiled element about the angles to both sides of the base position in which arrangement the working gap between the separating edge and the roll 33 (not shown) remains practically unchanged.

It will be appreciated by those skilled in the rt that varius modifications and variations can be made in the present invention without departing from the scope of the invention. It is intended that the present invention include such modifications and variations as come within the scope of the appended claims and their equivalents.

What is claimed is:

1. An apparatus for removing trash from a fiber/air stream flowing in a working gap in a textile machine, said apparatus comprising:

a trash eliminating device in communication with said working gap;

at least one adjustable separating element having an edge that is disposable at an angle into said working gap to deflect at least a portion of the fiber/air stream flowing therethrough;

at least one guide element disposed upstream from said separating element in a direction of flow of the fiber/air stream, said guide element adjustable so as to adjust a width of the working gap preceding said separating element; and means for operationally linking said separating element and said guide element such that an adjustment of either of said elements effects a coordinated adjustment of said other respective element.

2. The apparatus as in claim 1, wherein said separating element and said guide element are operationally linked such that adjustment of said elements has a cumulative effect in reducing or increasing efficiency of the trash separating operation of said apparatus depending on direction of adjustment of said elements.

3. The apparatus as in claim 2, wherein said separating element and said guide element are operationally linked such that adjustment of said elements has an offsetting effect in reducing or increasing efficiency of the trash separating operation of said apparatus depending on direction of adjustment of said elements.

4. The apparatus as in claim 1, wherein said separating element is angularly positionable such that a penetration depth of said edge into the working gap is adjustable.

5. The apparatus as in claim 1, wherein said separating element and said guide element are are separately movable.

6. The apparatus as in claim 5, wherein said separating element and said guide element are configured on separate support members rotatable about an axis for adjusting said elements.

7. The apparatus as in claim 1, further comprising a plurality of said separating elements and said guide elements wherein each said separating element has a respective said guide element upstream thereof and adjustable therewith.

8. The apparatus as in claim 7, wherein said trash eliminating device comprises a suction duct associated with each said separating element, each said suction duct in communication with said working gap.

9. The apparatus as in claim 1, further comprising a rotatable roll and a cover, said working gap defined between said rotatable roll and said cover.

10. The apparatus as in claim 1, wherein said trash eliminating device comprises a suction duct associated with said separating element and in communication with said working gap.

11. An apparatus for removing trash from a fiber/air stream flowing in a working gap in a textile machine, said apparatus comprising:

a trash eliminating device in communication with said working gap;

at least one pivotally adjustable separating element having an edge that is disposable at an angle into said working gap to deflect at least a portion of the fiber/air stream flowing therethrough;

a working gap through which the fiber/air stream flows defined upstream from said separating element with respect to a direction of flow of the fiber/air stream; and wherein said working gap is defined by at least one adjustable element; and means for operably configuring said adjustable element to move with said separating element and automatically adjust dimensions of said working gap with adjustments of said separating element.

12. The apparatus as in claim 11, wherein said trash eliminating device comprises a suction device in communication with said working gap adjacent said separating element.

13. The apparatus as in claim 11, wherein said adjustable element comprises a guide element adjustable in a direction transverse to the fiber/air stream flow.

14. The apparatus as in claim 13, wherein said guide element and said separating element are configured on separate support members.

15. The apparatus as in claim 14, wherein each said support member is rotatable on an axis.

16. The apparatus as in claim 15, further comprising a rotatable roll, the fiber/air stream flowing in said working gap along a circumferential portion of said roll, said roll paving a rotational axis that is generally in a same plane through said axis of said support member associated with said separating element and an edge of said separating element.

17. The apparatus as in claim 16, further comprising a plurality of said separating elements spaced circumferentially along a portion of said roll, each said separating element having a respective preceding working gap associated therewith and a respective trash eliminating device comprising a suction duct in communication with said working gap generally adjacent said separating element.

* * * * *